US010273050B2

(12) United States Patent
Gorab

(10) Patent No.: US 10,273,050 B2
(45) Date of Patent: Apr. 30, 2019

(54) CONTAINER IDENTIFICATION MARK

(71) Applicant: Glenn Gorab, Franklin Lakes, NJ (US)

(72) Inventor: Glenn Gorab, Franklin Lakes, NJ (US)

( * ) Notice: Subject to any disclaimer, the term of this patent is extended or adjusted under 35 U.S.C. 154(b) by 0 days.

(21) Appl. No.: 13/928,375

(22) Filed: Jun. 26, 2013

(65) Prior Publication Data

US 2015/0000818 A1 Jan. 1, 2015

(51) Int. Cl.

| | |
|---|---|
| ***B65C 3/00*** | (2006.01) |
| ***B65C 9/00*** | (2006.01) |
| ***B65D 23/00*** | (2006.01) |
| ***B65D 51/00*** | (2006.01) |
| ***B65D 65/00*** | (2006.01) |
| ***B65D 23/08*** | (2006.01) |
| ***B65D 23/14*** | (2006.01) |
| ***B65D 51/24*** | (2006.01) |

(52) U.S. Cl.

CPC ..... *B65D 23/0828* (2013.01); *B65D 23/14* (2013.01); *B65D 51/245* (2013.01); *Y10T 156/10* (2015.01)

(58) Field of Classification Search

CPC .... B65C 3/00; B65C 3/06; B65C 3/08; B65C 3/20; B65C 9/0006; B65C 9/18; B65D 23/08; B65D 23/0814; B65D 23/0821; B65D 23/0828; B65D 51/00; B65D 65/00

See application file for complete search history.

(56) References Cited

U.S. PATENT DOCUMENTS

| | | | | |
|---|---|---|---|---|
| 2,523,650 | A | 9/1950 | Dickson | |
| 4,095,824 | A | 6/1978 | Bachman | |
| 4,229,637 | A | 10/1980 | Dederer et al. | |
| 4,241,923 | A | 12/1980 | Meirovitz | |
| 4,508,513 | A | 4/1985 | Donovan | |
| 4,536,218 | A | 8/1985 | Gambo | |
| 4,589,685 | A | 5/1986 | Lazar | |
| 4,637,635 | A | 1/1987 | Levine | |
| 4,759,139 | A | 7/1988 | Ricks | |
| 4,846,504 | A * | 7/1989 | MacGregor | G09F 3/02 283/102 |
| 4,900,617 | A | 2/1990 | Smith | |
| 4,973,088 | A | 11/1990 | Levy | |
| 5,033,746 | A | 7/1991 | Jones | |
| 5,098,502 | A | 3/1992 | Smolinski | |
| 5,154,448 | A | 10/1992 | Griffin et al. | |
| 5,938,449 | A | 8/1999 | Masson et al. | |
| 6,594,927 | B2 * | 7/2003 | Witkowski | G09F 3/0288 40/306 |
| 6,972,151 | B2 | 12/2005 | Bronson | |
| 7,000,790 | B1 | 2/2006 | Bae | |

(Continued)

*Primary Examiner* — Jacob T Minskey
*Assistant Examiner* — Matthew Hoover
(74) *Attorney, Agent, or Firm* — Dilworth Paxson LLP; Edward F. Behm, Jr.

(57) ABSTRACT

A bottle or jar identification device comprising a multi-layer token that produces a permanent image when pressure is applied to a writing surface. The token may be affixed to the cap or cover or to the bottle or jar itself. The token can comprise a magic slate, ink meant to fail, lottery type rub-off material, microencapsulated ink, or any other material that produces an image when pressure is applied using a stylus, a fingernail, or any other sharp instrument. The token may also have an adhesive layer. The token having an adhesive layer may be applied to any surface.

14 Claims, 6 Drawing Sheets

(56) References Cited

U.S. PATENT DOCUMENTS

| | | | | |
|---|---|---|---|---|
| 7,300,694 | B2 | 11/2007 | Lutz et al. | |
| 2003/0184082 | A1 | 10/2003 | Bilble et al. | |
| 2005/0087467 | A1 | 4/2005 | Dao | |
| 2012/0050415 | A1* | 3/2012 | Falkner ..... | C09D 11/102<br>347/73 |

* cited by examiner

CONTAINER IDENTIFICATION MARK

BACKGROUND OF THE INVENTION

Bottles and jars come in various shapes and sizes. Most often they come paired with caps to keep the contents from spilling out. Many bottles and jars have labels that adhere to the surface in order that the user can identify the contents. However, some bottles or jars do not have labels. Even if they do have labels, bottles and jars do not have a means for providing identification of the user. Such identification becomes necessary, for example, at a childrens' sporting event. The children drink water from their own bottles, and then put them down while playing. When they come back to take another drink, their bottles may be interspersed among water bottles belonging to other children. Due to a limited number of brands, some or all of the children could have bottles that look alike. It is undesirable to have children drinking from open bottles belonging to other children. Another example where identification marking is desirable is on prescription bottles. Bottles containing prescription drugs normally have labels identifying the drug, but a user might want to jot down the next time he or she needs a dose. It would be desirable to have a means by which a person can easily mark his or her container (e.g., jar or bottle) with identifying information. Furthermore, such means for marking should not require the use of a pen or pencil. Marking should occur merely by pressing one's fingernail on the marking section.

A number of methods exist for marking bottles and jars. Most of these require the use of a pencil and pen to transfer graphite or ink onto a writable surface. However, there are surfaces that do not require a pencil or pen to make a visible marking.

magic slate;
ink meant to fail;
lottery type rub-off material; and
microencapsulated ink.

The magic slate is well established prior art. Since the early twentieth century, it was used by children and others to write messages and then quickly erase them. A magic slate comprises at least two components—a rigid waxy opaque surface and a thin flexible translucent material. Pressure, usually from a plastic stylus is applied to the translucent material in order to press it against the opaque surface. The pressure is applied by using the stylus to write a message. Wherever the translucent material comes in contact with the opaque surface, it loosely adheres to the opaque surface, and the color of the opaque surface is visible through the translucent material. To erase the message, the user merely pulls the translucent material away from the opaque surface. Most magic slates use a third component, i.e., a thin flexible transparent material. The translucent material is positioned between the transparent material and the opaque surface. The function of the transparent material is to protect the translucent material to prevent it from tearing because of the pressure applied to it by the stylus. Magic slates have been used to mark various packages (see U.S. Pat. No. 5,098,502 issued to Smolinski on Mar. 24, 1992).

The ink meant to fail and lottery-type rub-off surfaces are similar to each other in that material must be removed to produce an image. In both cases, a top layer of removable material is deposited on a more permanent surface. Application of pressure (e.g., from a stylus or fingernail) will remove the top layer thus exposing the more permanent surface. The ink meant to fail requires that a release agent layer (e.g., a surfactant) be applied onto the substrate below the ink layer. This agent causes the ink to bond very poorly to the substrate, thereby enabling it to be easily removed.

Finally, bank deposit slips and US Postal Service Express Mail mailing labels use microencapsulated ink to produce in image on duplicate slips and labels. This eliminates the more traditional carbon paper previously used to produce duplicates. The deposit slips and mailing labels are produced with the original and duplicates loosely fastened to each other to form a unitary product. The reverse side of the original deposit slip (as well as the reverse side of the original and one duplicate mailing label) is coated with a layer comprising microencapsulated ink. When encapsulated, the ink is invisible. Application of pressure to the original using a stylus, a fingernail, or other sharp pointed object breaks through the micro encapsulation, thereby releasing the ink and forming an image on the duplicates. If the microencapsulated ink were to be applied to the front surface rather than the rear surface of the paper, then applied pressure would produce an image directly on the front surface.

SUMMARY OF THE INVENTION

The Present Invention is a container identification device having a multi-layer token that produces a permanent image when pressure is applied to a writing surface. If the container is a bottle, the token may be affixed to the bottle cap or to the bottle itself. The token can comprise a magic slate, ink meant to fail, lottery type rub-off material, microencapsulated ink, or any other material that produces an image when pressure is applied using a stylus, a fingernail, or any other sharp instrument. The token may also have an adhesive layer. The token having an adhesive layer may be applied to any surface.

BRIEF DESCRIPTION OF THE DRAWINGS

FIG. 1A is a top plan view of the cap. Note the marking consisting of the letter 'G.'

FIG. 1B is a front elevation view of the cap.

FIG. 1C is a bottom plan view of the cap.

FIG. 1D is an isometric view of the cap.

FIG. 1E is a cross section of the cap.

FIG. 1F is a cross section of a thin slice in the center of the cap.

FIG. 7A is an isometric view of a sheet of paste-on tokens.

FIG. 7B is an isometric view of a roll of paste-on tokens.

FIG. 7C is an isometric view of a sheet of personalized paste-on tokens.

FIG. 7D shows a closed roll of paste-on tokens.

DETAILED DESCRIPTION OF THE INVENTION

Figure 1A:
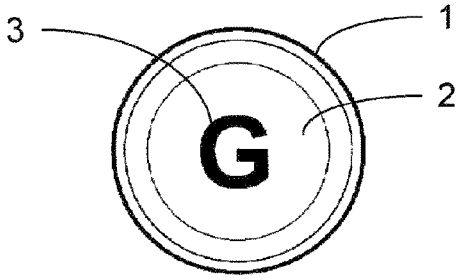
FIGS. 1A through 1F illustrate various views of the bottle cap.
Figure 1D:
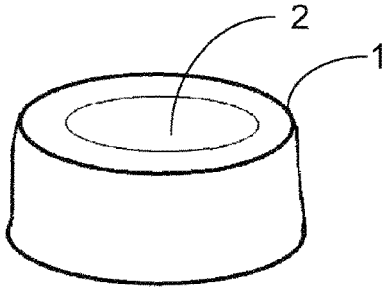
Figure 1B:
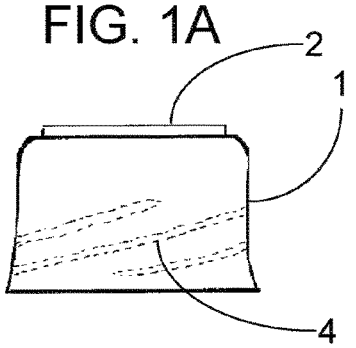
Figure 1E:
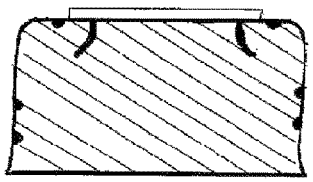
Figure 1C:
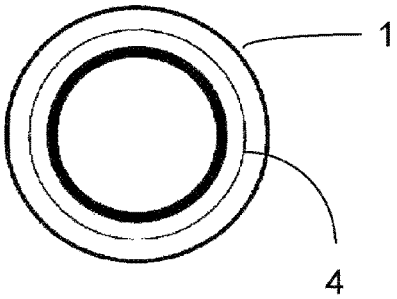
Figure 1F:
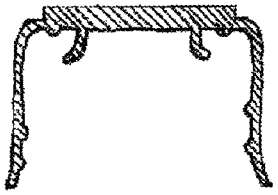
Figure 2:
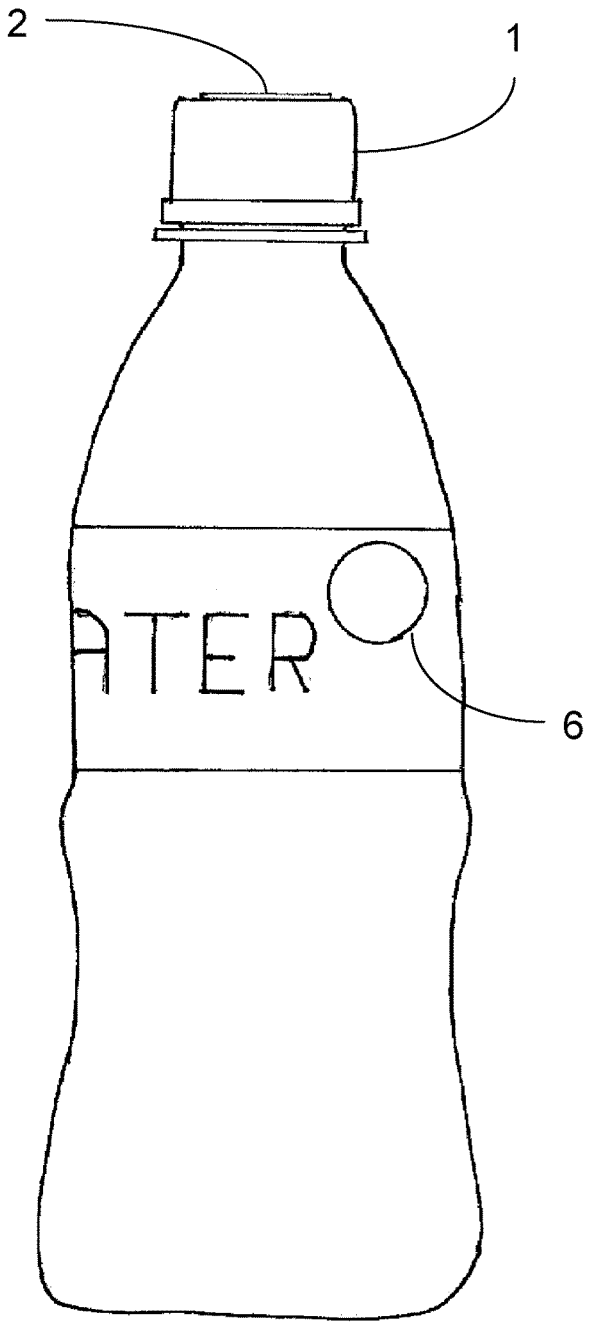
FIG. 2 illustrates a bottle having a cap as disclosed in the Present Application as well as a token applied to the surface of the bottle.

FIGS. 1A through 1F illustrate various views of the bottle cap, 1. Bottle cap 1 comprises the cap token 2, and cap 1 may have screw threads 4 (shown in FIGS. 1B, 1C, and 1E). Cap token 2 may be marked with pressure as shown at 3 in FIG. 1A. FIG. 2 illustrates a bottle having cap 1 affixed thereon. Cap token 2 is affixed to the bottle cap, and may be inserted to and made part of the cap or may be affixed to the top of the cap using adhesive on the back side. The bottle token 6 of the Present Invention may also be applied to the surface of the bottle.

Figure 3:
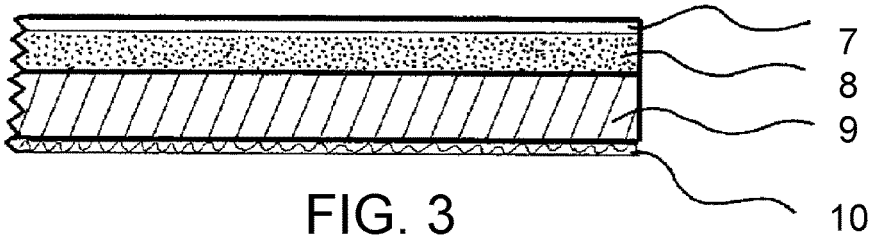
FIG. 3 is a cross section of the multi-layer magic slate type token.

FIG. 3 is a cross section of the magic slate type token having thin translucent layer 7, opaque layer 8, backing layer 9, and adhesive layer 10. Applying sharp pressure to translucent layer 7 makes said layer 7 stick to opaque layer 8. The color of layer 8 becomes visible as an image wherever said pressure is applied.

Figure 4:
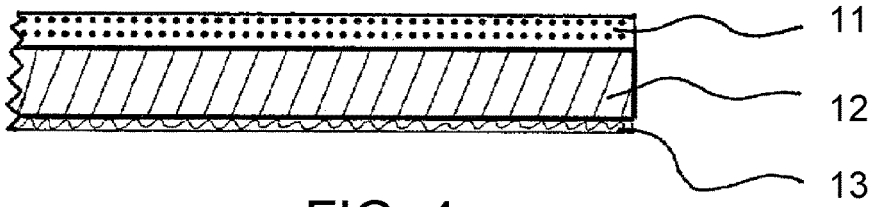
FIG. 4 is a cross section of the microencapsulated ink type token.

FIG. 4 is a cross section of the microencapsulated ink type token. A layer of microencapsulated ink 11 is applied to backing 12. An adhesive layer 13 is applied to the reverse side of layer 12. Application of sharp pressure to layer 11 releases the ink to produce an image wherever said pressure is applied.

Figure 5:
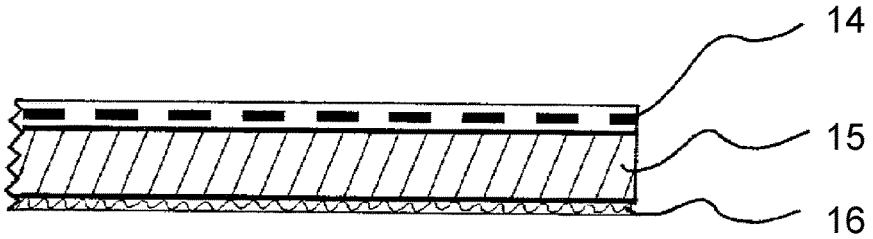
FIG. 5 is a cross section of the rub-off ink meant to fail type token.

FIG. 5 is a cross section of the ink meant to fail type token. The token comprises an ink layer 14, a writing surface 15, and an adhesive layer 16. Application of sharp pressure to ink layer 14 breaks the encapsulation, thereby releasing the ink to produce an image wherever said pressure is applied. This is accomplished by use of a release agent that is then inked. Two release agents that may be used for this purpose are:

1. Cork Industries makes a varnish which is UV cured to allow release of the ink from the substrate Its product number is Varnish2038HG1.
2. Henkel Corporation makes a product which is called Miracure. This is also UV cured and allows the release of ink. Its product number is L909IV.

Figure 6:
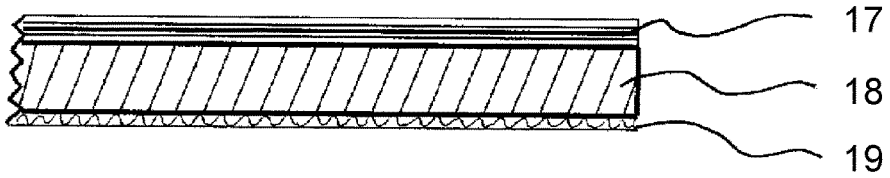
FIG. 6 is a cross section of the rub-off material (lottery type) token.

FIG. 6 is a cross section of the rub-off lottery type token. A rub-off material 17 is applied to backing layer 18. The token has an adhesive layer 19. Application of sharp pressure to rub-off material 17 removes it an exposes to view the portion of backing layer 18 wherever said pressure is applied.

Figure 7A:
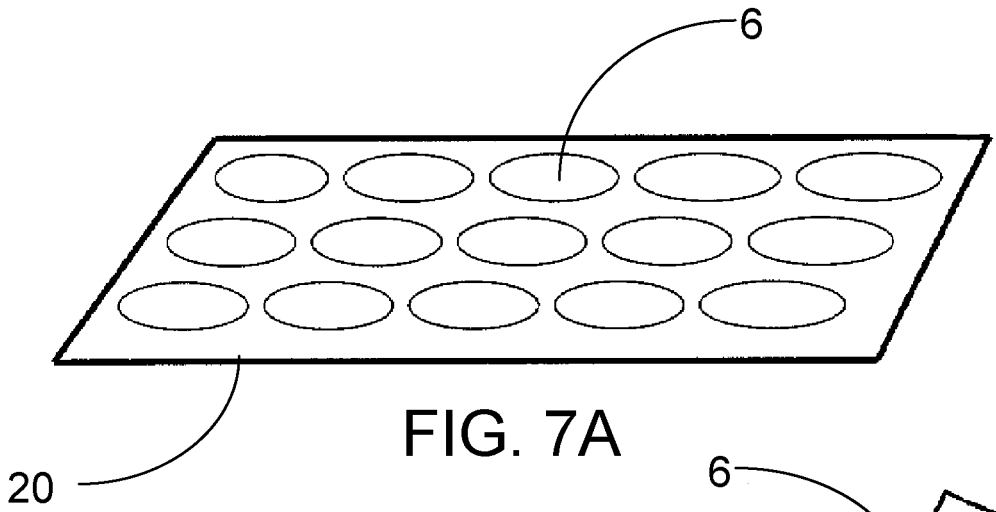
FIGS. 7A through 7D show tokens meant to be pasted onto bottles or caps.
Figure 7B:
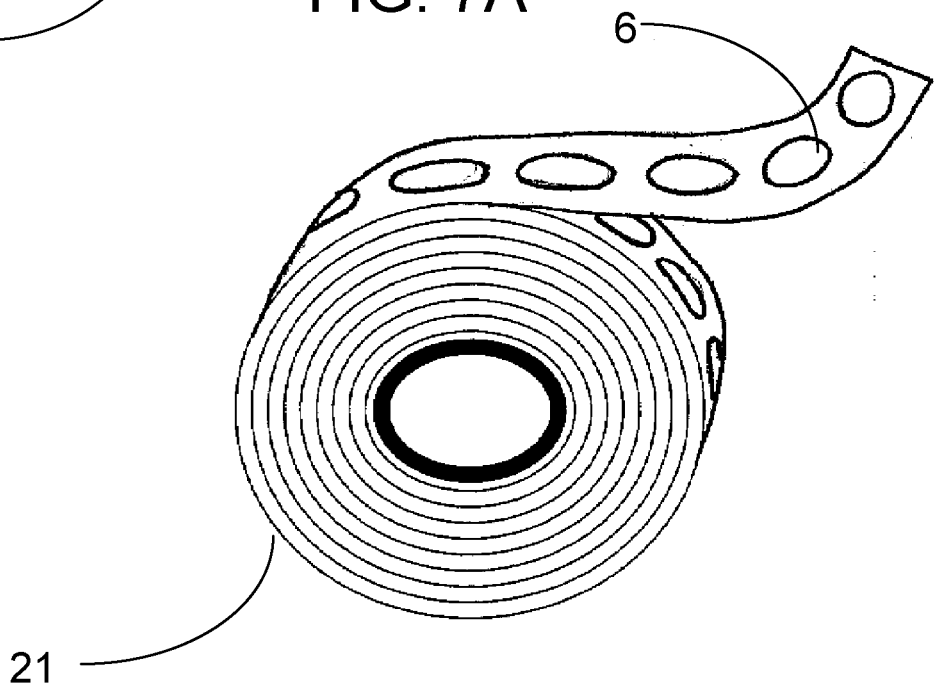
Figure 7C:
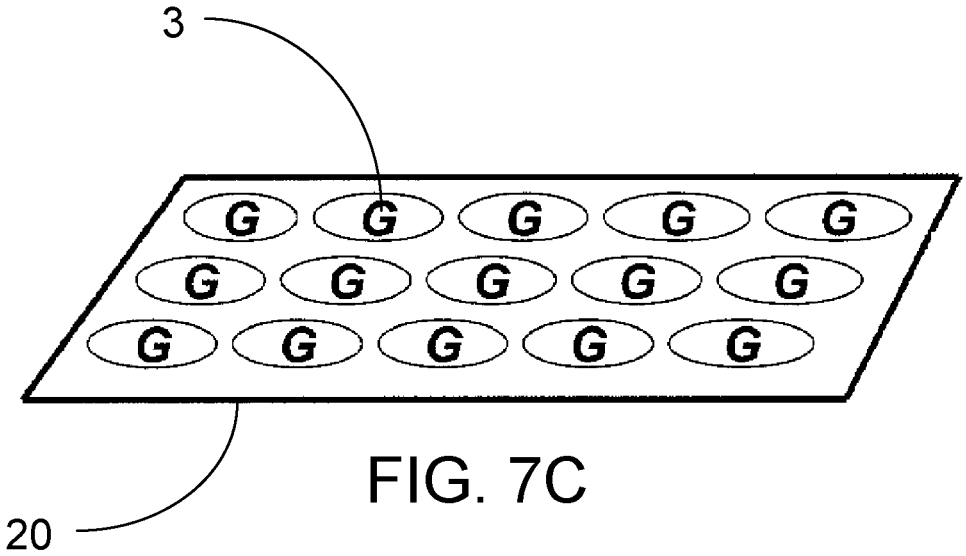
Figure 7D:
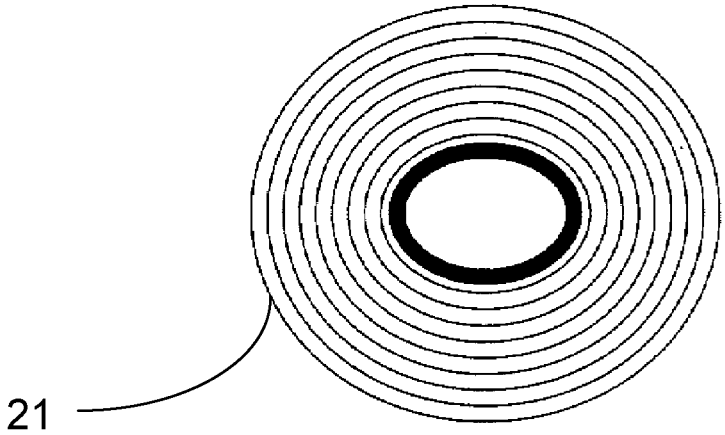

The token may either be an integral part of the cap or bottle (as sold), or it may be applied by the user. In the latter case, an exemplary embodiment would be paste-on tokens that can be peeled off a substrate and applied to the bottle or cap. The back-side surface of the tokens has an adhesive that adheres loosely to the substrate, but that adheres strongly to other surfaces. FIG. 7A shows bottle token 6 on a sheet substrate 20. FIG. 7B shows bottle token 6 on a rolled substrate. In both FIG. 7A and FIG. 7B, cap token 2 may be substituted for bottle token 6. FIG. 7C shows the pre-marked personalized token 3 on the sheet substrate 20. FIG. 7D shows a closed roll of tokens.

The container (e.g., bottle or jar) can be generalized as a hollow solid shape having at least one closed surface. Here, the Applicant chooses to be his own lexicographer when defining the term "closed surface." It will be defined herein as a solid set of planar or three-dimensional surface or surfaces, either alone or in combination, that envelopes a volume in such a manner that there is at least one plane within the volume that intersects the closed surface to form a continuously closed two-dimensional geometric figure. For example, a cylindrical surface that is open at both ends has a closed surface that envelopes a cylindrical volume wherein a plane other than one parallel to the cylindrical axis can intersect the closed surface to form either a circle or an ellipse. A box having four sides at right angles and open at both ends has a closed surface that envelopes a volume that is a cube or rectangular prism wherein a plane may intersect all four sides to form a rectangle.

I claim:

1. A method for permanently and irreversibly marking a container for identification purposes wherein the container comprises at least one side which in turn comprises at least one closed surface, said method comprising:

providing a label on an outer surface of the container including a portion comprising ink meant to irreversibly fail;

providing a token having an adhesive layer for adherence to at least one outer surface of the container, the token having an outward-facing layer comprising ink meant to irreversibly fail;

receiving pressure to the portion causing one or more permanent and irreversible markings to appear on the portion at locations of the received pressure; and receiving pressure to the token causing one or more permanent and irreversible markings to appear on the token at locations of the received pressure;

wherein the surface area of the portion is smaller than the surface area of the label.

2. The method of claim 1 wherein the label is affixed to at least one side of the container via an adhesive layer.

3. The method of claim 1 wherein the container further comprises a top and a bottom.

4. The method of claim 3 wherein the container further comprises a removable cap that is attached to the container at its top.

5. The method of claim 4 wherein the token is affixed to the removable cap.

6. The method of claim 1, wherein the pressure is applied to the token using a stylus, a fingernail, or a sharp instrument.

7. The method of claim 1, wherein the token is peeled off a substrate comprising a plurality of multi-layer tokens.

8. The method of claim 7, wherein the token adheres loosely to the substrate.

9. The method of claim 7, wherein the substrate is a sheet substrate.

10. The method of claim 7, wherein the substrate is a rolled substrate.

11. A container, comprising:

a top;

a bottom;

a rounded or flat side; and a label comprising a portion having an ink layer comprising ink meant to irreversibly fail;

wherein the container has a token adhered thereto comprising an adhesive layer for adhering to the container and an outward-facing layer comprising ink meant to irreversibly fail;

wherein upon receiving pressure to the portion causes permanent and irreversible markings; and wherein upon receiving pressure to the token causes permanent and irreversible markings.

12. The container of claim 11, wherein surface area of the portion is less than surface area of the label.

13. The container of claim 11, wherein the label is adhered to the container via an adhesive layer.

14. The container of claim 11, wherein the label is printed directly on the container.

* * * * *